United States Patent [19]

Melde-Tuczai et al.

[11] Patent Number: 4,836,162

[45] Date of Patent: Jun. 6, 1989

[54] ENGINE BRAKE OF AN INTERNAL COMBUSTION ENGINE

[75] Inventors: Helmut Melde-Tuczai; Johann Aigner; Othmar Skatsche, all of Graz, Austria

[73] Assignee: AVL Gesellschaft für Verbrennungskraftmaschinen und Messtechnik M.B.H. Prof.Dr.Dr.h.c. Hans List, Graz, Austria

[21] Appl. No.: 113,662

[22] Filed: Oct. 28, 1987

[30] Foreign Application Priority Data

Oct. 30, 1986 [AT] Austria ..... 2898/86

[51] Int. Cl.[4] ..... F01L 13/06; F02D 13/04

[52] U.S. Cl. ..... 123/321; 123/90.16

[58] Field of Search ..... 123/90.15, 90.16, 316, 123/320, 321, 322

[56] References Cited

U.S. PATENT DOCUMENTS

| | | | |
|---|---|---|---|
| 1,637,118 | 7/1927 | Kirchensteiner | 123/320 |
| 3,520,287 | 7/1970 | Calvin | 123/321 |
| 3,547,087 | 12/1970 | Siegler | 123/321 |
| 4,697,558 | 10/1987 | Meneely | 123/321 |

FOREIGN PATENT DOCUMENTS

| | | | |
|---|---|---|---|
| 111232 | 6/1986 | European Pat. Off. . | |
| 401760 | 1/1943 | Italy | 123/321 |

OTHER PUBLICATIONS

Pelizzoni, "Dynatard . . . Mack's New Engine Brake" in Automotive Industries, Feb. 15, 1971, pp. 49–52.

Greathouse et al., The Mack Maxidyne, ENDT 865 Diesel with Dynatard Engine Brake, SAE Meeting, Jun. 7–11, 1971, 710557.

Cummins et al., The Jacobs Engine Brake–A New Concept in Vehicle Retarders, SAE Meeting, Aug. 1961, 387A.

*Primary Examiner*—Tony M. Argenbright

*Attorney, Agent, or Firm*—Watson, Cole, Grindle & Watson

[57] ABSTRACT

An engine brake in an internal combustion engine for use in motor vehicles, comprising an exhaust valve controlled by a cam via a follower lever, and a device for leaving the exhaust valve slightly open during the combustion stroke. According to the invention the support bearing of the follower lever is designed to be adjustable in the direction of the supporting force P between two extreme positions, i.e. one corresponding to normal operation and the other one to braking, such that on braking the exhaust valve is lifted by 0.3 to 3 mm, preferably 0.5 to 2 mm, during the phase in which the base circle of the cam is in contact with the follower lever.

13 Claims, 3 Drawing Sheets

ENGINE BRAKE OF AN INTERNAL COMBUSTION ENGINE

BACKGROUND OF THE INVENTION

This invention relates to an engine brake of an internal combustion engine for motor vehicles, comprising an exhaust valve controlled by a cam via a follower lever, and a device for leaving the exhaust valve open by a small gap during the compression stroke.

DESCRIPTION OF THE PRIOR ART

Engine brakes of this type are known and represent retarders which are integrated in the engine. Leaving the exhaust valve open by a small gap during the compression stroke is a known idea which has already been put into practice by companies such as Mack and the Jacobs Manufacturing Company.

Mack published their findings in the Feb. 15, 1971 issue of the magazine "Automotive Industry" (pp 49 to 52), in addition to a description in the SAE Paper 710557. The valve concerned in this instance is located on the rocker shaft and controls the oil pressure in two oil bores on the rocker shaft in such a way that a hydraulic element in the rocker arm is lifted continuously during normal operating conditions, gliding over a relief in the base circle of the cam, and that this element becomes hydraulically rigid upon braking, and that the exhaust valve is kept open even when the element is in contact with the base circle of the cam.

The exhaust brake designed by Jacobs is described in the SAE Paper No. 387 A. In this design a hydraulic element presses directly against the exhaust valve. The elements and their control mechanism are contained in a rather complex housing which is mounted on the cylinder head. This type of construction is shown in European Patent No. 0 111 232, in combination with an oil pump. The disadvantage of this exhaust brake is the expensive additional component required.

SUMMARY OF THE INVENTION

It is an object of the present invention to avoid the disadvantages of the known types of engine brake and to design an engine brake of similar effectiveness, which should be simpler and cheaper, however.

According to the invention the support bearing of the follower lever is designed to be adjustable in the direction of the supporting force between two extreme positions, i.e. one corresponding to normal operation and the other one to braking, such that on braking the exhaust valve is lifted by 0.3 to 3 mm, preferably 0.5 to 2 mm, during the phase when the base circle of the cam is in contact with the follower lever.

In a further development of the invention the support bearing of the follower lever is provided by a plunger which is located in a housing inserted in the cylinder head, and is permitted to move axially in the direction of the supporting force of the follower lever within a given travel range, and whose end facing away from the support bearing of the follower lever is acted upon by pressurized oil, which will force the plunger into the extreme position corresponding to braking operation. This type of design makes use of the pressurized oil already provided by the internal combustion engine, and thus facilitates control. The control mechanism of this type of engine brake may also be coupled to the ordinary braking system of the vehicle.

In a preferred variant of the invention the housing within which the plunger slides axially is inserted in the cylinder head in the direction of the supporting force of the follower lever, where it surrounds a support bearing of this lever, while its end facing away from the support bearing of the follower lever carries a nut which is screwed into an internal thread of the housing and which has an inlet opening for the pressurized oil flowing in through a bore in the cylinder head, for instance.

If the engine brake is to be controlled mechanically instead of hydraulically, the support bearing of the follower lever is configured as a threaded part which cooperates with a nut integrated in the cylinder head, and which, together with the support bearing, can assume two extreme positions, one for normal operation and the other one for braking. In this instance it may be of advantage if the threaded part is a screw bolt and if the nut is configured as a flange that is secured against turning on the cylinder head, and if the screw bolt has a pinion rigidly attached to its lower end, which meshes with a toothed rod and whose upper end is configured as a pan serving as the support bearing of the follower lever.

According to another variant of the invention the threaded part may also be configured as a screw bolt that is tightly fitted into the cylinder head, for instance by pressing, while the nut screwed onto this bolt may serve as a support bearing for the follower lever and may be adjusted by a control rod attached to it. This variant is characterized by its great simplicity of design.

DESCRIPTION OF THE DRAWINGS

Following is a more detailed description of the invention as illustrated by the attached drawings, in which.

DETAILED DESCRIPTION OF THE PREFERRED EMBODIMENTS

Figure 1:
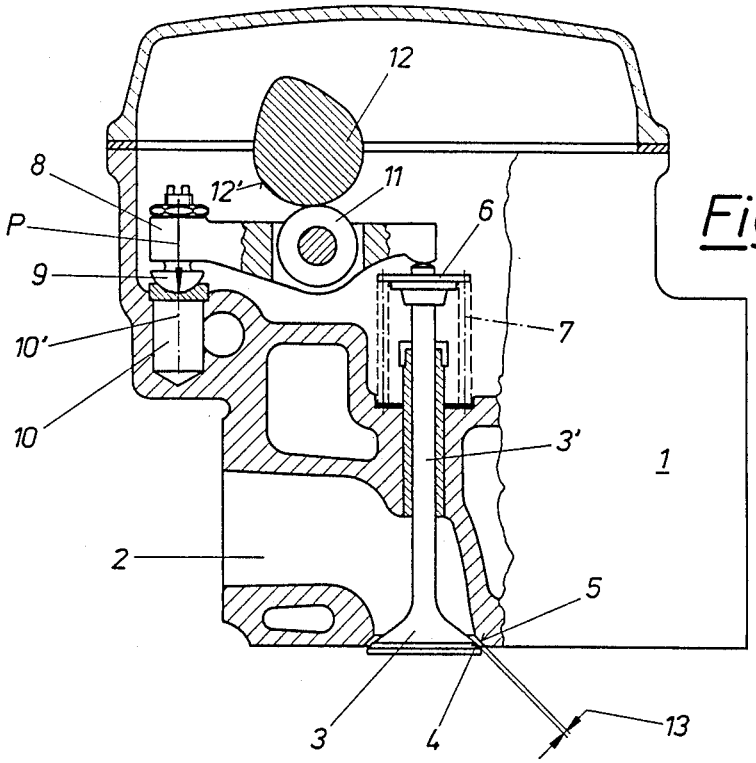
FIG. 1 is a sectional view of an engine brake as described by the invention.

The cylinder head 1 contains an exhaust port 2 with the exhaust valve 3. This exhaust valve 3 has a conical seat surface 4; the corresponding valve seat in the cylinder head 1 is marked 5. At the end of the valve stem 3' is provided a valve spring retainer 6 holding the valve spring 7, such that the ball-shaped pivot 9 of the follower lever 8 is pressed against the support bearing 10, while the roller 11 of the lever is pressed against the cam 12. In the braking position of the support bearing 10 shown here the roller 11 is in contact with the cam 12 along its base circle 12', and the exhaust valve 3 is left open by a small gap 13 which is achieved by lifting the pivot 9 of the lever 8 by means of the support bearing 10.

The support bearing 10 is axially moveable in the direction of an axis 10', which is identical with the direction of the supporting force P of the follower lever 8 on the support bearing 10, the upper extreme position shown here corresponding to braking operation and the lower extreme position corresponding to normal operation.

In the braking position a valve lift of 0.3 to 3 mm is achieved, preferably 0.5 to 2 mm. This will prevent the air from being compressed, forcing it into the exhaust pipe through the gap 13 of the exhaust valve 3, which acts as a throttle. The energy carried by the air is transformed into heat at the throttle, and is given off partly to the exhaust pipe and partly to the cooling water of the engine. In this way the engine is protected from excessive cooling even during prolonged downhill runs.

With this arrangement the braking power may be doubled as compared to a conventional exhaust brake, and no other engine-independent brakes are needed that would be heavy and expensive.

Figure 2:
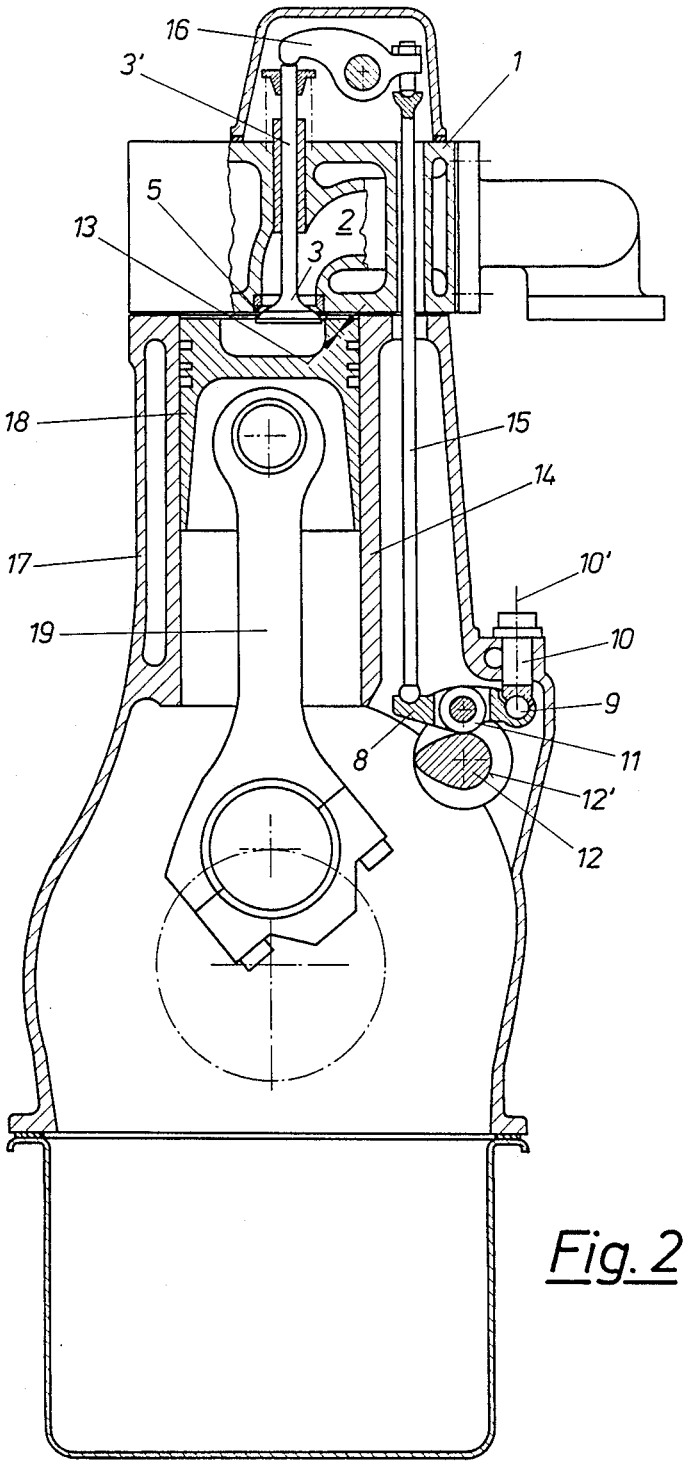
FIG. 2 is a sectional view of another variant of the invention along the cylinder axis, and FIGS. 3, 4, 5 give different variants of a detail which may be used with the configurations of both FIG. 1 and FIG. 2.

In the variant shown in FIG. 2 all parts that are identical with those in FIG. 1 have the same reference numbers. The exhaust valve 3 is actuated from the cam 12 located below the cylinder 14 via the follower lever 8, the tappet push-rod 15 and the rocker lever 16. The pivot 9 of the follower lever 8 rests on the support bearing 10. In the braking position shown here the exhaust valve 3 is slightly lifted from its seat surface 5 at the cylinder head 1, thus forming the gap 13, which may be 0.5 to 2 mm wide. The roller 11 of the follower lever 8 is in contact with the base circle 12' of the cam 12.

The crankcase is marked 17, the piston 18 and the connecting rod 19; these parts are not described here any further, however, as they are not vital to the invention.

Figure 3:
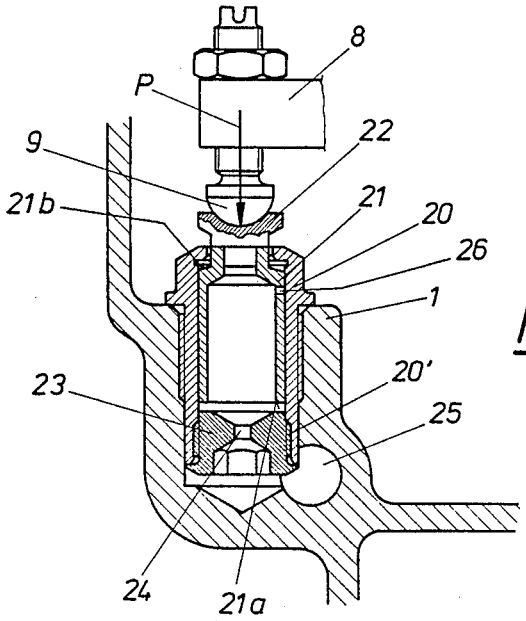
Figure 4:
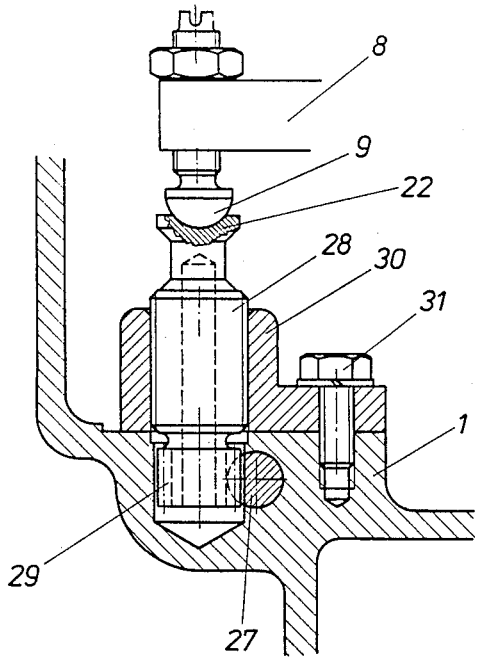
Figure 5:
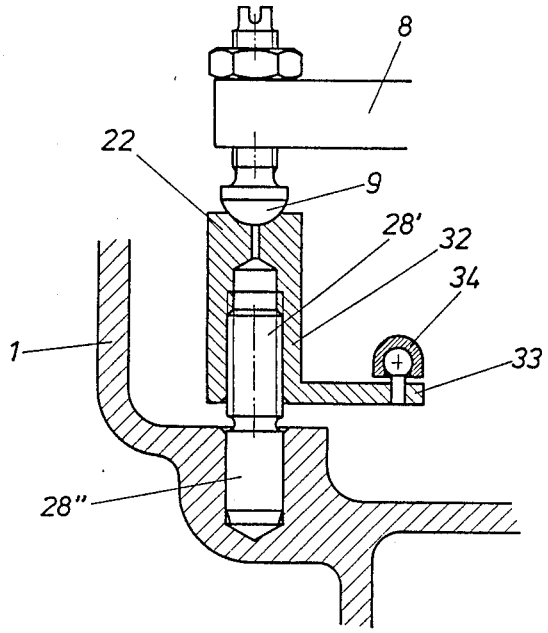

The support bearing 10 may be actuated hydraulically (FIG. 3) or mechanically (FIGS. 4, 5).

In the hydraulic variant as presented in FIG. 3 a plunger 21 is provided, which is axially moveable in a housing 20, and whose upper end is shaped as a pan 22 receiving the pivot 9 of the follower lever 8. The housing 20 is inserted into the cylinder head 1 and carries a nut 23 which is fastened to the lower end of the housing by an interior thread 20', and which serves as the lower stop **21*a* of the plunger 21 and contains the inlet opening 24 for the pressurized oil fed through bore 25 in the cylinder head 1. The upper stop of the plunger 21 representing the moveable support bearing is marked 21*b*; the vent bore is referred to as 26**.

Upon braking pressurized oil is pressed into the bore 25, and the plunger 21 is lifted to its upper stop **21*b*. During normal operation of the engine the pressure in the bore 25 is reduced and the plunger 21 is pressed downward by the cam 12**, or rather the camshaft. In this position of the support bearing the exhaust valve will remain closed during the base circle phase of the cam.

The mechanical variant of the moveable support bearing as presented in FIG. 4 provides a threaded part 28 with a pinion 29 at its lower end meshing with a toothed rod 27, and a pan 22 at its upper end receiving the pivot 9 of the follower lever 8. The nut 30 is configured as a flange and is secured on the cylinder head 1 by screws 31 to prevent it from turning.

In the mechanical variant of the moveable support bearing as described in FIG. 5 the threaded part 28' is press-fitted into the cylinder head 1 by means of a cylindrical pin 28''. The nut 32 is turned via a lever 33 by the control rod 34 whose ball-joint is shown here. The pan 22 is provided by the upper end of the nut 32.

We claim:

1. An engine brake of an internal combustion engine for motor vehicles, comprising an exhaust valve controlled by a cam via a follower lever situated in a cylinder head, said follower lever comprising a support bearing which is adjustable in the direction of a supporting force between two extreme positions, forming a device for leaving said exhaust valve open by a small gap during compression strokes, one of said extreme positions corresponding to normal operation and the other to braking, such that on braking said exhaust valve is lifted by 0.3 to 3 mm, during the phase in which the base circle of said cam is in contact with said follower lever, said support bearing of said follower level being provided by a plunger, which is located in a housing inserted in said cylinder head, said plunger being permitted to move axially in the direction of said supporting force of said follower lever within a given travel range, said plunger having an end facing away from said support bearing of said follower lever which is acted upon by pressurized oil, which will force said plunger into said extreme position corresponding to braking.

2. An engine brake according to claim 1, wherein said housing within which said plunger slides axially, is inserted in said cylinder head in the direction of said supporting force of said follower lever, one end of said housing surrounding said support bearing of said lever, while said end facing away from said bearing carries a nut which is screwed into an internal thread of said housing, said nut has an inlet opening for said pressurized oil flowing in through a bore in said cylinder head.

3. An engine brake of an internal combustion engine for motor vehicles, comprising an exhaust valve controlled by a cam via a follower lever situated in a cylinder head, said follower elver comprising a support bearing which is adjustable in the direction of a supporting force between two extreme positions, forming a device for leaving said exhaust valve open by a small gap during compression strokes, one of said extreme positions corresponding to normal operation and the other to braking, such that on braking said exhaust valve is lifted by 0.3 to 3 mm, during the phase in which the base circle of said cam is in contact with said follower lever, said support bearing of said follower lever being configured as a threaded part, which cooperates with a nut integrated in said cylinder head, and which, together with said support bearing, can assume said two extreme positions, one of said two positions for normal operation and the other for braking.

4. An engine brake according to claim 3, wherein said threaded part is a screwed bolt and said nut is configured as a flange secured against turning on said cylinder head, and wherein said threaded part has a pinion rigidly attached to its lower end, which pinion meshes with a toothed rod, its upper end being configured as a pan serving as said support bearing of said follower lever.

5. An engine brake according to claim 3, wherein said threaded part is configured as a screw bolt, which is tightly fitted into said cylinder head by pressing, and wherein a nut screwed onto said bolt serves as said support bearing of said follower lever, and is adjusted by a control rod attached to it.

6. An engine brake of an internal combustion engine for motor vehicles comprising, a cylinder head, an exhaust valve controlled by a cam via a pivoted follower lever, a support bearing for said follower lever having a seat cooperating with a seat of said follower lever, said cooperating seats defining the pivot point about which said lever pivots, means for adjusting said support bearing in the direction of the main supporting force between two extreme positions, one of said extreme positions corresponding to normal operation and the other to braking, such that on braking said exhaust valve is lifted by 0.3 to 3 mm during the phase in which the base circle of said cam is in contact with said follower lever.

7. An engine brake as defined in claim 6 wherein said means for adjusting the support bearing comprises a housing inserted in said cylinder head, a plunger axially movable within said housing in the direction of the main supporting force of the follower lever within a given travel range between extreme positions, said plunger having an end facing away from the seat of said follower lever which end is actuated by pressurized oil to force said plunger into said extreme position corresponding to braking.

8. An engine brake as defined in claim 7, wherein said housing is threaded into said cylinder head in the direction of said main support force of said follower lever, said housing having an end facing away from said seat carrying a nut which is threaded into an internal thread of said housing, said nut having an inlet opening for said pressurized oil flowing in through a bore in said cylinder head.

9. An engine brake as defined in claim 6 wherein said support bearing of said follower lever is configured as a threaded part which cooperates with a nut integrated in said cylinder head, and which, together with said support bearing, can assume said two extreme positions, one of said two positions for normal operation and the other for braking.

10. An engine brake as defined in claim 9, wherein said threaded part is a threaded bolt and said nut is configured as a flange secured against turning on said cylinder head, and wherein said threaded part has a pinion rigidly attached to its lower end, said pinion meshing with a toothed rod, its upper end being configured as a pan serving as said support bearing on said follower lever.

11. An engine brake as defined in claim 9 wherein said threaded part is configured as a screw bolt, which is tightly fitted into said cylinder head by pressing, and wherein a nut screwed onto said bolt serves as said support bearing of said follower lever, and is adjusted by a control rod attached to it.

12. An engine brake as defined in claim 6, wherein said exhaust valve is lifted by 0.5 to 2 mm, during the phase in which the base circle to said cam is in contact with said follower lever.

13. An engine brake of an internal combustion engine for motor vehicles comprising, a cylinder head having an exhaust port, and exhaust valve for opening and closing said port, means biasing said valve into closed position, a support bearing supported by said cylinder head, a follower lever having one end portion thereof pivotally mounted on said bearing, the opposite end portion of said lever being interconnected with said valve for moving the valve into open position, a rotatable cam, a cam follower mounted on an intermediate portion of said lever and engaging said cam, and means for adjusting said support bearing in the direction of the main supporting force between two extreme positions, one of said extreme positions corresponding to normal operation and the other to braking, such that on braking said exhaust valve is opened a predetermined amount during the phase in which the base circle of said cam is in contact with said cam follower.

* * * * *